US010330300B2

(12) United States Patent
Li

(10) Patent No.: US 10,330,300 B2
(45) Date of Patent: Jun. 25, 2019

(54) SYSTEMS AND DESIGN FACILITATING REMOTELY CONTROLLING AN IMITATION CANDLE DEVICE

(71) Applicant: Xiaofeng Li, Shenzhen (CN)

(72) Inventor: Xiaofeng Li, Shenzhen (CN)

( * ) Notice: Subject to any disclaimer, the term of this patent is extended or adjusted under 35 U.S.C. 154(b) by 234 days.

(21) Appl. No.: 15/336,553

(22) Filed: Oct. 27, 2016

(65) Prior Publication Data

US 2018/0031219 A1 Feb. 1, 2018

(30) Foreign Application Priority Data

Jul. 28, 2016 (CN) ..... 2016 1 0605957

(51) Int. Cl.

| | |
|---|---|
| ***F21V 23/00*** | (2015.01) |
| ***F21S 10/04*** | (2006.01) |
| ***F21S 6/00*** | (2006.01) |
| ***F21V 14/00*** | (2018.01) |
| *F21W 121/00* | (2006.01) |

(52) U.S. Cl.

CPC ..... *F21V 23/009* (2013.01); *F21S 6/001* (2013.01); *F21S 10/043* (2013.01); *F21S 10/046* (2013.01); *F21V 14/00* (2013.01); *F21W 2121/00* (2013.01)

(58) Field of Classification Search

None

See application file for complete search history.

(56) References Cited

U.S. PATENT DOCUMENTS

| | | | | |
|---|---|---|---|---|
| 7,359,183 | B2 * | 4/2008 | Wu | G06F 1/1632 361/679.01 |
| 8,184,452 | B2 * | 5/2012 | Lee | H05K 5/0278 361/727 |
| 2006/0158138 | A1 | 7/2006 | Walter et al. | |
| 2008/0123277 | A1 * | 5/2008 | Achsaf | H05K 5/0278 361/679.01 |
| 2015/0233538 | A1 * | 8/2015 | Sheng | F21S 10/046 362/190 |
| 2017/0067608 | A1 * | 3/2017 | Patton | F21S 10/046 |

* cited by examiner

*Primary Examiner* — Dimary S Lopez Cruz
(74) *Attorney, Agent, or Firm* — Perkins Coie LLP

(57) ABSTRACT

Apparatus and configurations for imitation candle devices that facilitate remote operation and usage of electronic candles are described. The disclosed features include an assembly to hold a detachable electronic module for an imitation candle device. The assembly comprises an installation cavity formed inside of a body of the imitation candle device, including: a first subspace extending between a first surface and an opening; a second subspace extending between a second surface and the opening, wherein the second surface is recessed and is situated at a first distance from the opening; and a third subspace extending between a third surface and the opening, wherein the third surface is recessed and is situated at a second distance that is greater than the first distance from the opening; and an engagement element that extends into the installation cavity through the opening.

23 Claims, 10 Drawing Sheets

SYSTEMS AND DESIGN FACILITATING REMOTELY CONTROLLING AN IMITATION CANDLE DEVICE

RELATED APPLICATIONS

This patent document claims priority to Chinese patent application no. CN201610605957.8 filed on Jul. 28, 2016. The entire contents of the before mentioned patent application is incorporated by reference in this patent document.

FIELD OF INVENTION

The subject matter of this patent document relates to systems and apparatus for facilitating remotely controlling of imitation candle devices that use an imitation flame.

BACKGROUND

Traditional true flame candles, when lit, provide a pleasant ambience in many homes, hotels, churches, businesses, etc. Traditional candles, however, provide a variety of hazards including risk of fire, damage to surfaces caused by hot wax, and the possible emission of soot. Flameless candles have become increasingly popular alternatives to traditional candles. With no open flame or hot melted wax, flameless candles provide a longer-lasting, safe, and clean alternative.

Such imitation candle devices often include light sources, such as LEDs, and include electronic circuits that control the operation the imitation candle device. Furthermore, additional electronic modules can be deployed in the imitation candle device to facilitate the operations and control of electronic candle devices. For example, an imitation candle device may be controlled remotely (e.g., via a user's mobile device) using wireless communication methodologies.

SUMMARY OF CERTAIN EMBODIMENTS

The disclosed embodiments relate to different aspects of an installation cavity that holds a detachable electronic module in an imitation candle device. The detachable electronic module, when attached to the imitation candle device, connects to the central control circuitry of the imitation candle device to enable and facilitate remote control operations of the imitation candle device.

One exemplary aspect of the disclosed embodiments relates to an assembly to hold a detachable electronic module for an imitation candle device. The assembly comprises an installation cavity formed inside of a body of the imitation candle device, including: a first subspace extending between a first surface and an opening, wherein the first surface is adapted to engage an insertion interface of the electronic module to form a connection with a communication interface of the imitation candle device and the opening allows insertion or ejection of the detachable electronic module, the first subspace further bounded by a side wall, a second subspace extending between a second surface and the opening, wherein the second surface is recessed and is situated at a first distance from the opening, and the side wall includes a groove that runs from the second surface at least partially down the side wall toward the first surface, and a third subspace extending between a third surface and the opening, wherein the third surface is recessed and is situated at a second distance that is greater than the first distance from the opening; and an engagement element that extends into the installation cavity through the opening to allow secure connection of the electronic module with the communication interface of the imitation candle device.

In another exemplary aspect, an imitation candle device that can be controlled remotely is disclosed. The imitation candle device comprises a flame element shaped to resemble a candle flame and protruding from top of the imitation candle device; a body including an installation cavity; one or more light sources operably configured in the body; an electronic circuitry coupled to the flame element and the one or more light sources to control motion of the flame element and lighting of the one or more light sources; and an electronic module, configured to be installed in the installation cavity, that couples with the electronic circuitry to facilitate remote controlling of the imitation candle device. The installation cavity comprises a first subspace extending between a first surface and an opening, wherein the first surface is adapted to engage an insertion interface of the electronic module to form a connection with a communication interface of the imitation candle device and the opening allows insertion or ejection of the electronic module, the first subspace further bounded by a side wall, a second subspace extending between a second surface to the opening, wherein the second surface is recessed and is situated at a first distance from the opening, and the side wall includes a groove that runs from the second surface at least partially down the side wall toward the first surface, and a third subspace extending between a third surface and the opening, wherein the third surface is recessed and is situated at a second distance that is greater than the first distance from the opening.

DETAILED DESCRIPTION OF CERTAIN EMBODIMENTS

In this patent document, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner.

Imitation candle devices can simulate a real candle with a flame that resembles a real-life flame with flickering effects using optical, mechanical and electrical components. The disclosed embodiments provide further features and functionalities that enhance the operation of these devices, and in some cases, enable additional features, such as aesthetic and decorative features, that cannot be obtained with real candles.

Currently, with the continuous progress of science and technology, a variety of new technologies have been developed for imitation candle devices. However, attentions are focused on the appearance and the verisimilitude of the lighting effects. It is notable that improvements regarding the internal design of the candle device are also crucial to ensure the successful manufacture of a compact and robust imitation candle device.

Figure 1:
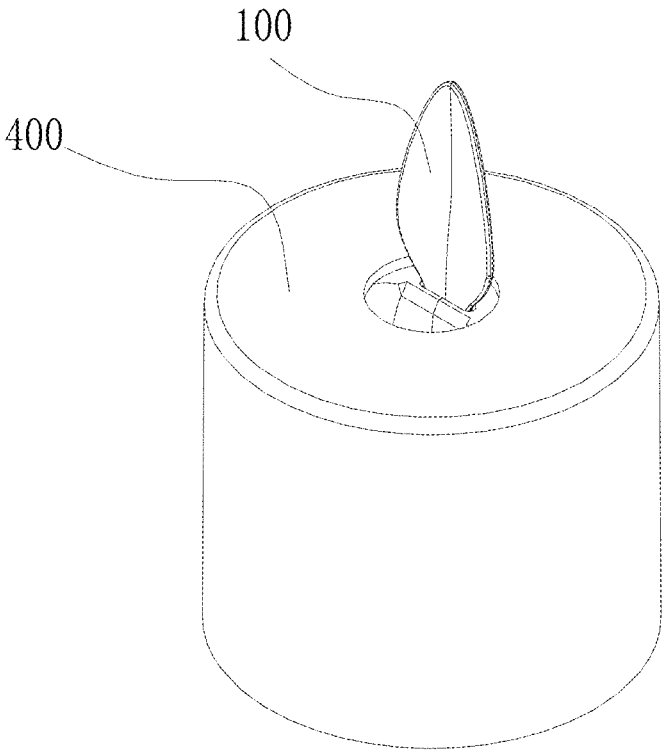
FIG. 1 illustrates an exemplary components of an imitation candle device that includes a shell.

FIG. 1 illustrates an exemplary imitation candle device. The imitation candle device includes a flame element 100 and a shell 400, mimicking the appearance of a real candle. The shell 400 covers internal components of the candle device, which can include one or more light producing devices (not shown in FIG. 1 but shown as 280 in FIG. 2) that illuminate the flame element 100 under the control of a circuit board (not shown). FIG. 1 illustrates one example of an imitation candle device having a flame element 100 that does not move when being illuminated by a light source. Other exemplary imitation candled devices can include a movable flame element. For example, in some implementations, where the flame element is a movable component, the movement of the flame element 100 may also be governed by the circuit board according to a regular pattern, or in accordance with an irregular pattern, depending on the desired visual effects.

It is desirable to be able to remotely control the operations of the imitation candle to, for example, the turn it on or off, to activate a timer setting, to change the color, intensity and/or flickering pattern of the light that illuminates the flame element 100, to control the movement of the flame element 100 (in devices that include a movable flame element), or other operations. To accomplish these and other remove operations, the candle device must include the proper circuitry to receive and decode the remote signals. While it is possible to include permanent receiver circuitry in a candle device, in some implementations it is desirable to include a removable electronic module that can be easily connected to, and removed from, the electronic candle. It is also desirable to maintain the natural appearance of a real candle; thus the electronic module should be placed within the candle body so that it does not interfere with the genuine look and feel of a candle. The disclosed embodiments address the above and other issues by forming an installation cavity within the candle body. The features of the installation cavity alone, or in combination with the features of the electronic module, enable easy installation and removal of the electronic module without interfering with the natural appearance of the candle.

Figure 2:
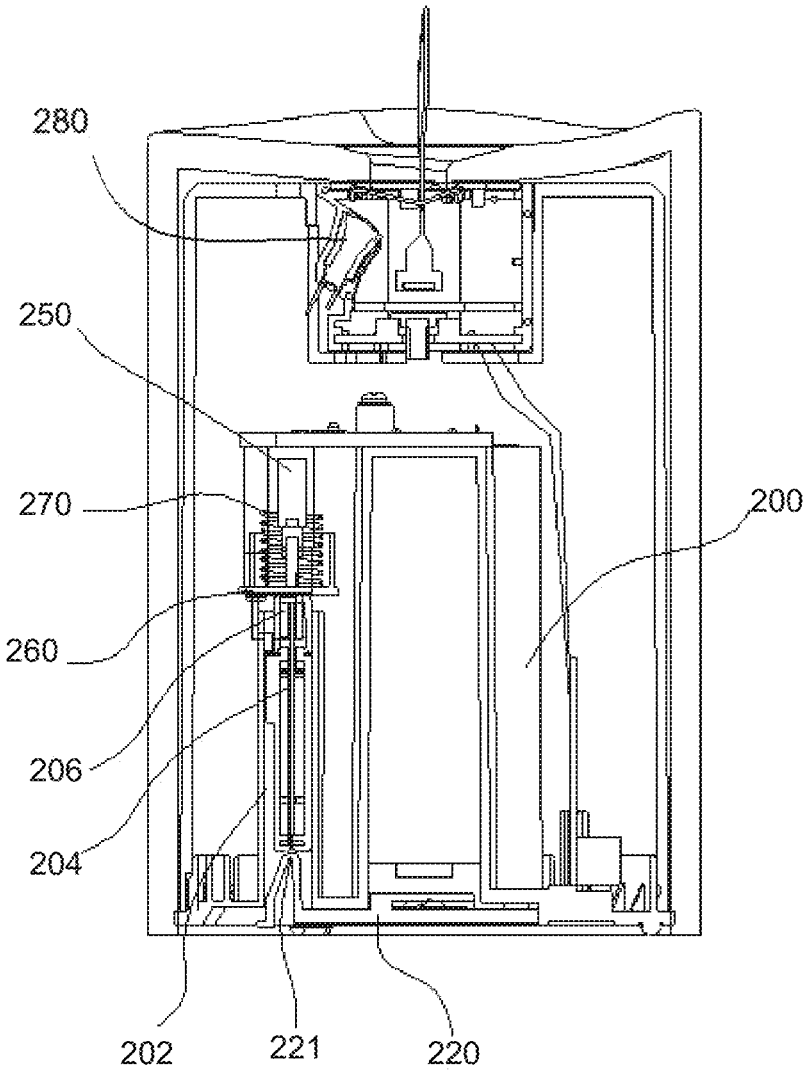
FIG. 2 is an exemplary view of an imitation candle device that illustrates an installation cavity as well as mechanical and electrical components of the imitation candle device.

FIG. 2 illustrates some of the mechanical and electrical components of an exemplary imitation candle device having an installation cavity and an electronic module. The imitation candle includes a body 200 and an installation cavity 202 in which an electronic module 204 may be installed. The electronic module 204 can be a wireless communication unit, a timing unit. It can also include additional components or capabilities such as a control unit to control the motion of a flame element, or a control unit to control light emitting elements. Once the electronic module 204 is inserted into the installation cavity 202, it connects to a communication interface 206 to exchange information with the central control of the imitation candle device, such as a PCB board, thereby providing desired function as needed. In some embodiments, the electronic module 204 is a Bluetooth communication module. In some embodiments, the electronic module 204 can also be a WiFi communication module or a high-frequency communication module.

The electronic module 204 is a standalone, detachable component that can communicate with different imitation candle devices. For example, a user may unplug a timing unit from an imitation candle device and replace it with a Bluetooth communication unit. In some embodiments, when an imitation candle device no longer requires remote control functionality, its electronic module can be unplugged and shared with another imitation candle device.

As depicted in the embodiment of FIG. 2, the body of the imitation candle device 200 further includes a compartment cover 220 to cover the battery compartment 210. The compartment cover 220 includes an engagement element 221 that is formed as a protrusion at one end of the compartment cover 220. The imitation candle device further includes a lock 250, an ejection component 260, and an elastic element 270. These components will be discussed in further detail in connection with FIGS. 5, 6(A) and 6(B).

Figure 3:
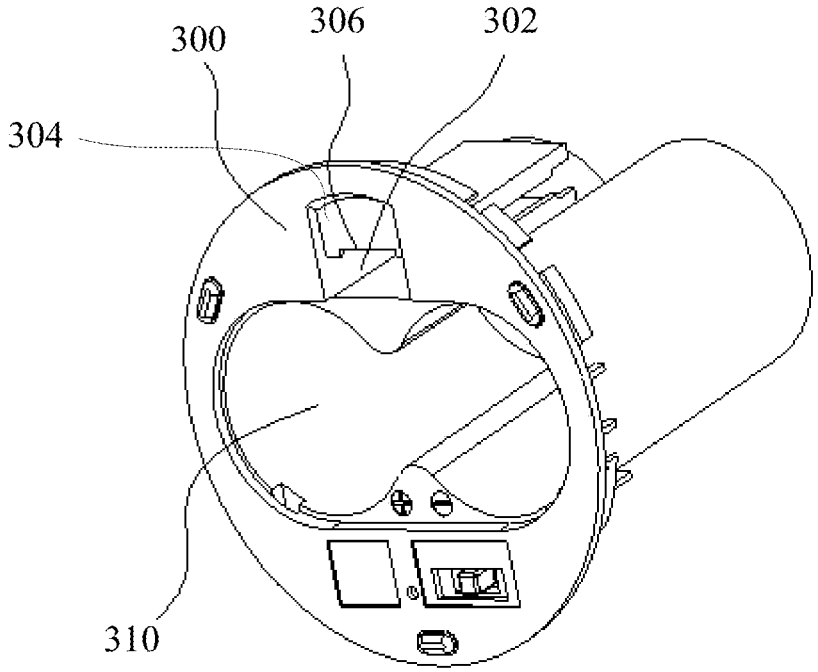
FIG. 3 illustrates an exemplary view of an installation cavity within the imitation candle body.

FIG. 3 shows an exemplary installation cavity 302 within the imitation candle body 300. The installation cavity 302 is located next to the battery compartment 310. The opening of the installation cavity 302 is exposed when the battery compartment cover is taken off, allowing insertion and installation of the electronic module. The installation cavity further includes a step feature 304. The step feature 304 comprises a surface that is recessed from the opening of the installation cavity to create a recessed space. This recessed space allows the engagement element 221 and the compartment cover 220 (see FIG. 2) to couple with the installation cavity when the compartment cover 220 closes. In some embodiments, the installation cavity 302 may be positioned in other places within the body of the imitation candle. The installation cavity 302 may be formed as one integral piece, or be formed by assembling a plurality of parts that are engaged with one another.

As depicted in FIG. 3, the side wall of the installation cavity 302 further includes a groove 306 that starts from the surface of the step feature 304 and runs, at least partially, down the main subsection of installation cavity. The groove 306 provides a mechanism for the electronic module to engage with the installation cavity in proper orientation. In some embodiments, the electronic module includes a raised surface 921 (see FIG. 9). The raised surface 921, together with the groove 306, can guide the user to insert electronic module into the installation cavity with correct orientation.

In some embodiments, the shape of the main subsection of the installation cavity matches the shape of the electronic module. The shape can be rectangular, cylindrical, or other specific forms.

Figure 4:
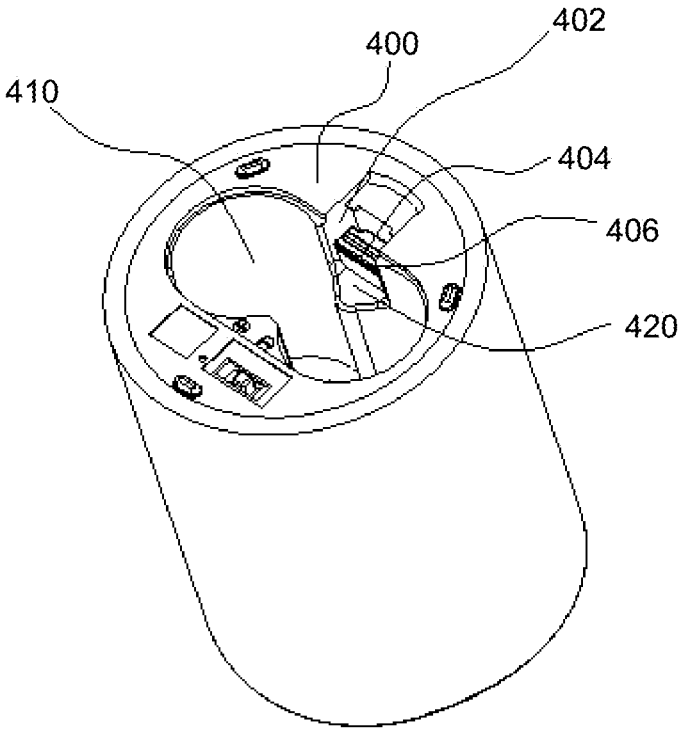
FIG. 4 shows another exemplary view of an installation cavity, coupled with an electronic module, within the imitation candle body.

FIG. 4 shows another exemplary installation cavity 402, coupled with an electronic module 404, within the imitation candle body 400. In this embodiment, the installation cavity 402 includes a recess 420 that provides access to the electronic module 404 when it is inserted in the installation cavity 402. The recess 420 includes a surface that is at a distance from the bottom surface of the candle. In the embodiment depicted in FIG. 4, the surface of the recess 420 is formed within the battery compartment 410; it exposes at least part of the battery compartment 410 to the installation cavity 402. Such configuration ensures that the total volume of the imitation candle device does not increase. The surface of the recess 420 can also be formed with other components within the imitation candle body 400 to maintain the same total volume of the imitation candle device.

Figure 10A:
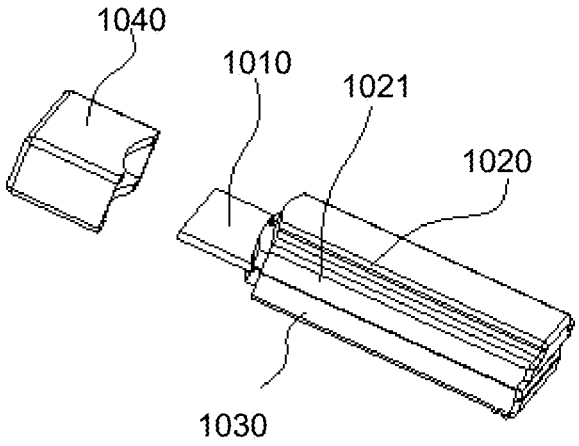
FIG. 10(A) shows another exemplary electronic module.

The recess 420 allows a user to readily make contact with the electronic module 404 that has been inserted into the installation cavity 402 using his or her fingers, facilitating easy removal of the electronic module 404 when necessary. In some embodiments, the electronic module 404 may include a surface feature 406, which is located at an end of the electronic module housing to facilitate the access of the electronic module. The combination of the recess 420 of the installation cavity 402 and the surface feature 406 of the electronic module 404 enhances the ability to readily reach for and remove the electronic module 404. The surface feature 406 will be discussed in further details in connection with FIG. 10.

Figure 5:
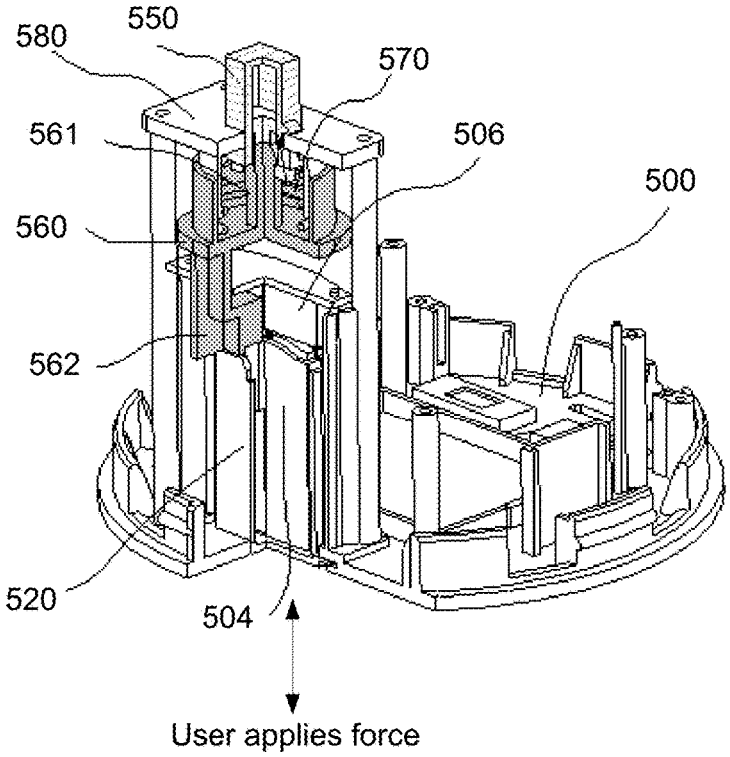
FIG. 5 shows exemplary structures of an imitation candle device having an installation cavity.
Figure 6A:
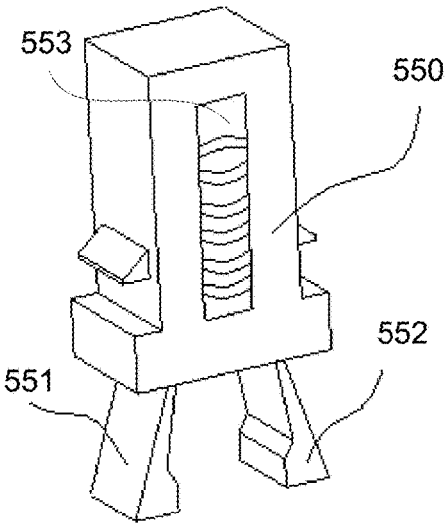
FIG. 6(A) shows an exemplary snap lock.
Figure 6B:
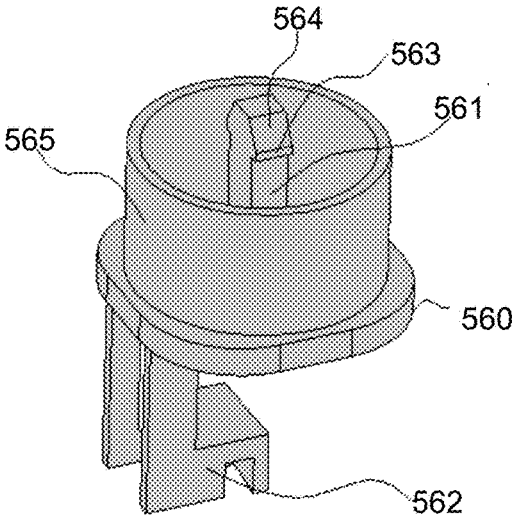
FIG. 6(B) illustrated an exemplary ejection component.

The imitation candle device may include an ejection mechanism to eject the electronic module when it needs to be taken out from the installation cavity. FIG. 5 shows an exemplary embodiment of the imitation candle device that includes such an ejection mechanism. As shown in FIG. 5, the ejection mechanism includes an ejection component 560 and a lock 550 that is capable of locking and ejecting the ejection component 560. The lock 550 can be mounted on the body 500 permanently by a fixing bracket 580. Exemplary embodiments of the ejection component 560 and a lock 550 are further illustrated in FIG. 6(A) and FIG. 6(B). In the embodiment shown in FIG. 6(A), the lock 550 is a snap lock that comprises a pair of clip legs, 551 and 552, and a spring 553. FIG. 6(B) shows a corresponding embodiment of the ejection component 560. The ejection component 560 comprises a support leg 561 to press the snap lock 550. Protrusions 563 are symmetrically arranged at the top of the support leg 561 so that the snap lock 550 can lock the ejection element via the pair of clip legs 551 and 552. The protrusions 563 may also include guiding slopes 564 to facilitate smooth locking of the support leg 561 with the clip legs 551 and 552 of the snap lock 550. The ejection component depicted in FIG. 6(B) also includes an ejection leg 562 to press against the electronic module 504 (see FIG. 5).

In operation, when a user applies a force to the electronic module 504 to insert it into the installation cavity 520, as shown in FIG. 5, the electronic module 504 pushes against the ejection leg 562, which causes a movement of the ejection element 560 towards the lock 550. The ejection element 560 presses against the clip legs 551 and 552 of the lock 550. The support leg 561, facilitated by the guiding slopes 564, engages with the lock 550 via the clip legs 551 and 552. When the user applies a force again to the electronic module 504 to remove it from the installation cavity, the electronic module 540 is pressed against the ejection leg 562 again. The electronic module 540 pushes the ejection element 560 towards the lock 550. The engaged support leg 561 now presses against the lock 550, causing its spring 553 to compress. The compressed spring 553 further pulls the clip legs 551 and 552 apart, releasing and disengaging the support leg 561. The electronic module 504 then can be ejected and removed from the installation cavity.

In some embodiments, an elastic element 570 is further included as a part of the ejection mechanism to facilitate the ejection of the electronic module. The elastic element can be a spring 270, as demonstrated in FIG. 2. The elastic force provided by the elastic element 570 can drive the ejection component 560 further toward the installation opening to facilitate successful ejections. In the embodiment shown in FIG. 6(B), the ejection component 560 includes a cylinder-shaped middle section 565 that has an opening that faces upward. The support leg 561 is located at the center of the middle section 565. The ejection leg 562 is located at the bottom of the middle section 565 and extends downwardly. In some embodiments, the elastic element 570, such as a spring, is arranged within the cylindrical body of the middle section 565.

The ejection mechanism may be optional if the recess 420, as depicted in FIG. 4, allows a user to manually make contact with a surface of the electronic module to remove the electronic module. Pulling out the electronic module by hand may be more advantageous to the ejection mechanism due to factors like materials aging and structural deformation of the parts. Furthermore, manufacturing cost can be reduced if fewer parts are required for the installation cavity.

Figure 7:
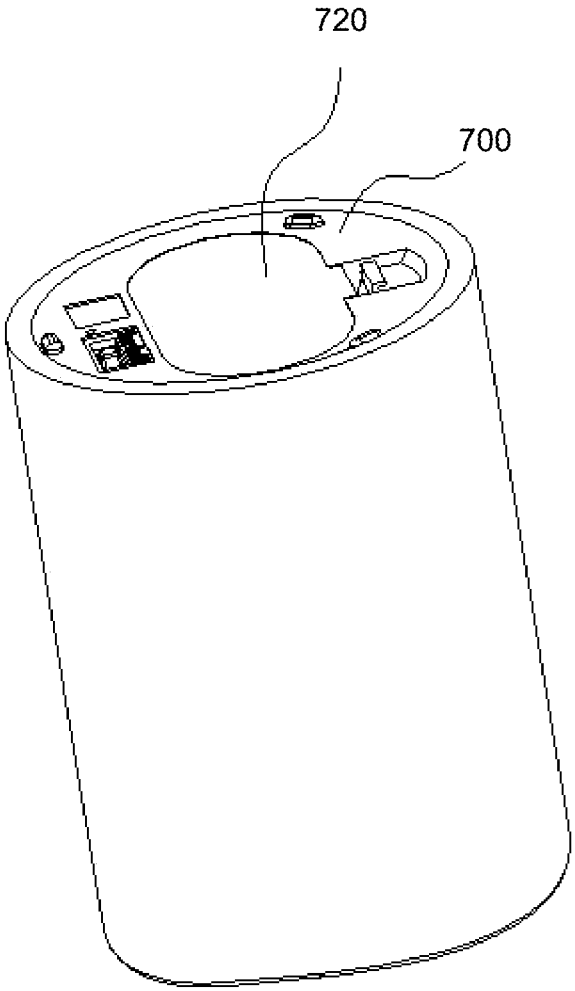
FIG. 7 is another exemplary view of an imitation candle device that illustrates a compartment cover in a closed configuration.

FIG. 7 shows an embodiment of an imitation candle device having an installation cavity with its compartment cover 720 closed. The compartment cover 720 simultaneously covers the battery compartment and the installing cavity. The installation cavity and the corresponding electronic module are completely hidden once the compartment cover 720 closes the bottom of the imitation candle device.

Figure 8:
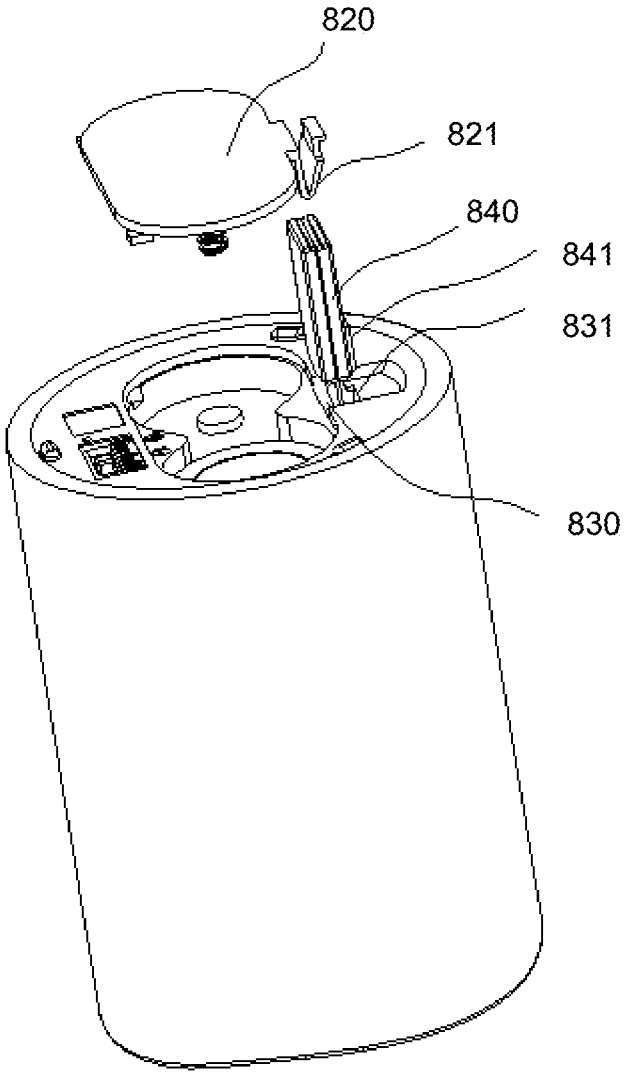
FIG. 8 illustrate an exemplary view of an imitation candle device with a compartment cover open.

FIG. 8 shows an embodiment of an imitation candle device having an installation cavity with its compartment cover 820 open. When the compartment cover 820 is open, the electronic module 840 can be inserted to the installation cavity 830 through the opening. The electric module 840 can be pushed towards the communication interface to achieve the connection therewith.

The engagement element 821, in this embodiment, is formed as a part of the compartment cover 820. The engagement element 821 is arranged on the compartment cover 820 in a protrusive manner, and extends into the installing cavity 830. The height of the engagement element 821 ensures that the electronic module 840 can be pushed inwardly to connect with the communication interface. In some embodiments, the engagement element 821 may be arranged separately from the compartment cover 820.

The groove 831 that runs at least partially down the main subsection of the installation cavity 830 couples with a raised surface 841 on the electronic module 840. The groove 831, together with the raised surface 841, guide the user to place the electronic module 840 within the installation cavity 830 with proper orientation; this way a user can easily, and without guesswork, install the electronic module 840.

Figure 9:
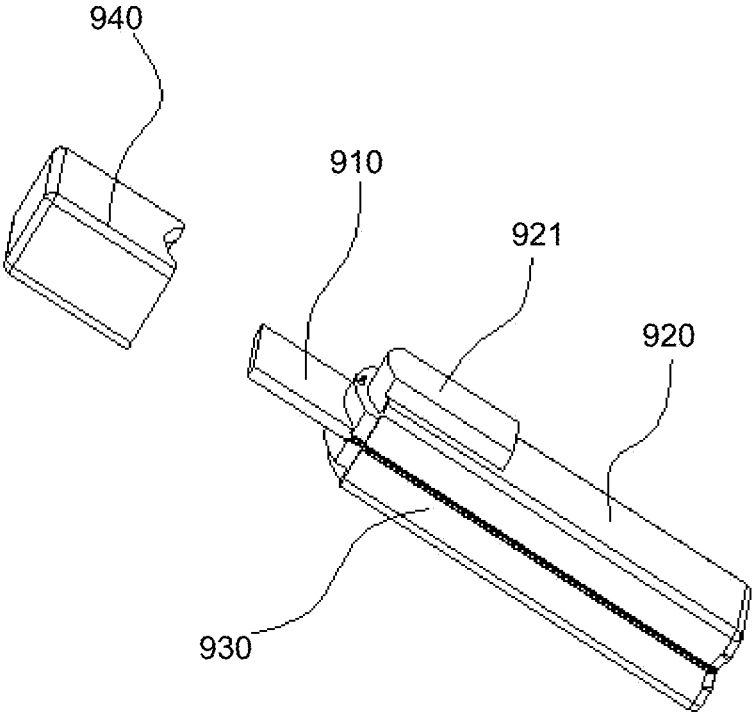
FIG. 9 illustrates an exemplary electronic module.

FIG. 9 shows an exemplary embodiment of the electronic module as a Bluetooth unit. The Bluetooth unit may include an insertion interface 910 that, when the Bluetooth unit is inserted into the installation cavity, connects to the communication interface in the imitation candle device. The insertion interface 910 is also connected to a communication circuit board installed in a housing of the unit. In the embodiment shown in FIG. 9, the housing includes a first housing (or a first section of a housing) 920 and a second housing (or a second section of the housing) 930. A communication circuit board can be positioned between the first housing 920 and the second housing 930. In some embodiments, the housing of the unit comprises an integral housing that encloses the communication circuit board.

In some embodiments, the Bluetooth unit may further include a raised surface 921 to engage with the groove 306 defined in the installation cavity, as shown in FIG. 3. The Bluetooth unit can be successfully installed only when the raised surface 921 is aligned with the groove 306. The raised surface 921 may be positioned near the insertion interface 910, as shown in FIG. 9. In some embodiments, the raised surface may alternatively be positioned on the surface of the first housing 920 close to the middle or further away from the insertion interface 910. In some embodiments, such as the one shown in FIG. 10(A), the raised surface 1021 is formed to cover the entire length of the surface of the first housing 1020.

Furthermore, the Bluetooth unit may further comprise a cap 940 or 1040. When the Bluetooth unit is not in use, the cap 940 or 1040 can cover the exposed section of the insertion interface 910 or 1010 in order to protect the communication circuit board.

In some embodiment, the raised surface 921 may be rectangular or have other shapes. The design of the raised surface 921 and the groove 306, as depicted in FIG. 3, can also be interchanged: the electronic module may comprise a groove that at least partially run down its first housing and the installation cavity may include a raised surface that engages with the groove to ensure correct installation of the electronic module.

Figure 10B:
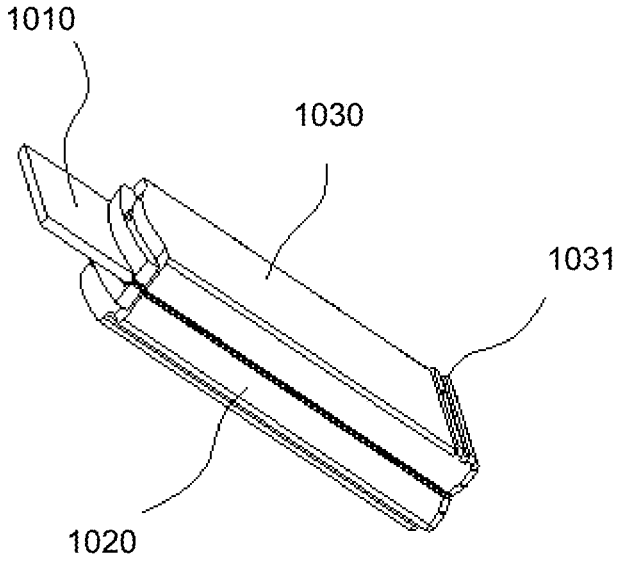
FIG. 10(B) shows yet another exemplary electronic module.

In some embodiments, as shown in FIG. 10(B), the second housing 1030 of the electronic module comprises a protruding surface feature 1031 so that a user can readily make contact with the electronic module using his or her fingers. The surface feature 1031 is located at the end that is away from the insertion interface 1010. As depicted in FIG. 4, after the electronic module 404 is inserted into the installation cavity 402, the surface feature 406 is accessible to the user through the recess 420. When the electronic module 404 needs to be taken out, a user can directly take out the electronic module from the installation cavity 402 by hand without requiring any additional ejection mechanism.

Figure 11:
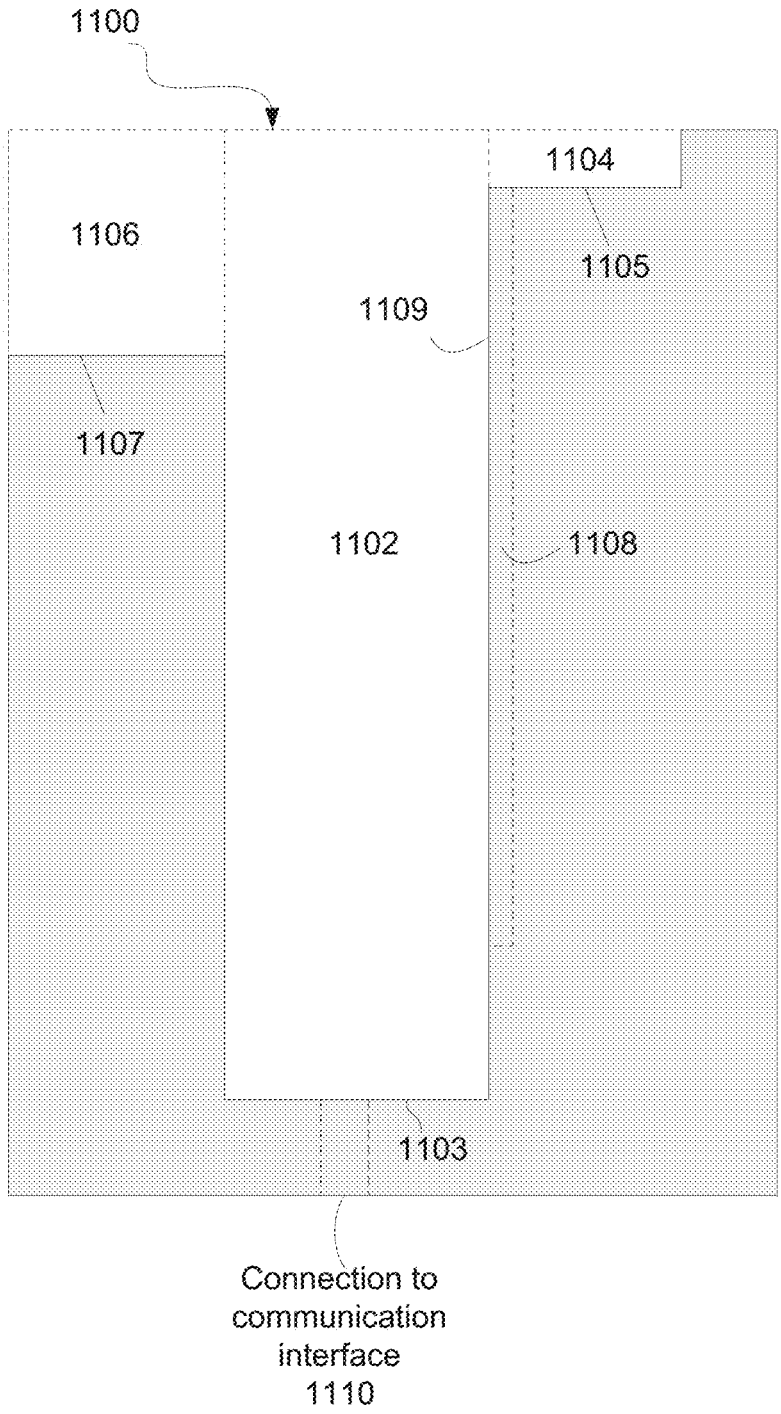
FIG. 11 shows an exemplary schematic design of an installation cavity.

An exemplary schematic design of the assembly to hold a detachable electronic module in an imitation candle device is shown in FIG. 11. The assembly includes an installation cavity and an engagement element. In this embodiment, the installation cavity includes three subspaces. A first subspace 1102 extends between a first surface 1103 and an opening 1100, and holds the electronic module when it is inserted. The first surface 1103 is adapted to engage an insertion interface of the electronic module to form a connection with a communication interface of the imitation candle device 1110 and the opening allows insertion or ejection of the detachable electronic module. The pair of dotted lines at the bottom of FIG. 11 illustrate a rectangular subsection that can accept the insertion interface of the electronic module (see also FIG. 2). The first subspace is further bounded by a side wall 1109.

The embodiment shown in FIG. 11 also includes a second subspace 1104 extending between a second surface 1105 and the opening 1100. The second subspace is also referred to as a step feature in FIG. 3. The second surface 1105 is recessed and is situated at a first distance from the opening 1100, and the side wall 1109 includes a groove 1108 that runs from the second surface 1108 at least partially down the side wall 1109 toward the first surface 1103. This subspace provides space to engage other components, such as the compartment cover 220 shown in FIG. 2, in order to close the opening of the installation cavity. The functionality of the groove 1108 is discussed in detail in connection with FIG. 3 and FIG. 8.

The embodiment also includes a third subspace 1106, which is also referred to as a recess in FIG. 4, extending between a third surface 1107 and the opening 1100. The third surface is recessed and is situated at a second distance that is greater than the first distance from the opening 1100. The functionality of the third subspace is discussed in detail in connection with FIG. 4.

The embodiment depicted in FIG. 11 further includes an engagement element that extends into the installation cavity through the opening 1100 to allow secure connection of the electronic module with the communication interface of the imitation candle device 1110. An exemplary implementation of the engagement element is shown in FIG. 8.

Some of the disclosed components be implemented as devices or modules using hardware circuits, software, or combinations thereof. For example, a hardware electronic circuit implementation can include discrete analog and/or digital components that are, for example, integrated as part of a printed circuit board. Alternatively, or additionally, the disclosed components or modules can be implemented as an Application Specific Integrated Circuit (ASIC) and/or as a Field Programmable Gate Array (FPGA) device. Some implementations may additionally or alternatively include a digital signal processor (DSP) that is a specialized microprocessor with an architecture optimized for the operational needs of digital signal processing associated with the disclosed functionalities of this application. Similarly, the various components or sub-components within each module may be implemented in software, hardware or firmware. The connectivity between the modules and/or components within the modules may be provided using any one of the connectivity methods and media that is known in the art, including, but not limited to, communications over the Internet, wired, or wireless networks using the appropriate protocols.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. An assembly to hold a detachable electronic module in an imitation candle device, comprising:

an installation cavity formed inside of a body of the imitation candle device, including:

a first subspace extending between a first surface and an opening, wherein the first surface includes a rectangular subsection to accept an insertion interface of the detachable electronic module to form a connection with a communication interface of the imitation candle device and the opening allows insertion or ejection of the detachable electronic module, the first subspace further bounded by a side wall;

a second subspace extending between a second surface and the opening, wherein the second surface is recessed and is situated at a first distance from the opening, and the side wall includes a groove that runs from the second surface at least partially down the side wall toward the first surface;

a third subspace extending between a third surface and the opening, wherein the third surface is recessed and is situated at a second distance that is greater than the first distance from the opening; and an engagement element that extends into the installation cavity through the opening to allow secure connection of the detachable electronic module with the communication interface of the imitation candle device.

2. The assembly of claim 1, further comprising:

a lock including two clip legs; and an ejection component including:

a support leg;

protrusions on the support leg to allow insertion of the support leg into the two clip legs; and an ejection leg configured to extend towards an opposite direction of the support leg.

3. The assembly of claim 2, wherein the ejection component further includes:

a middle section that surrounds the support leg; and an elastic element arranged within the middle section to facilitate ejection of the detachable electronic module.

4. The assembly of claim 3, wherein the elastic element includes a spring.

5. The assembly of claim 3, wherein the support leg of the ejection component further comprises guiding slopes to facilitate insertion of the support leg into the lock.

6. The assembly of claim 1, wherein the first subspace of the installation cavity has a rectangular shape.

7. The assembly of claim 1, wherein the first subspace of the installation cavity has a cylindrical shape.

8. The assembly of claim 1, wherein the third subspace is formed within a battery compartment of the imitation candle device.

9. An imitation candle device that can be controlled remotely, comprising:

a flame element shaped to resemble a candle flame and protruding from top of the imitation candle device;

a body including an installation cavity;

one or more light sources operably configured in the body;

an electronic circuitry coupled to the one or more light sources to control lighting of the one or more light sources; and an electronic module, configured to be installed in the installation cavity, that couples with the electronic circuitry to facilitate remote control of the imitation candle device, wherein the installation cavity comprises:

a first subspace extending between a first surface and an opening, wherein the first surface includes a rectangular subsection to accept an insertion interface of the electronic module to form a connection with a communication interface of the imitation candle device and the opening allows insertion or ejection of the electronic module, the first subspace further bounded by a side wall;

a second subspace extending between a second surface to the opening, wherein the second surface is recessed and is situated at a first distance from the opening, and the side wall includes a groove that runs from the second surface at least partially down the side wall toward the first surface; and a third subspace extending between a third surface and the opening, wherein the third surface is recessed and is situated at a second distance that is greater than the first distance from the opening.

10. The imitation candle device of claim 9, wherein the electronic module is a wireless communication module.

11. The imitation candle device of claim 9, wherein the electronic module is a Bluetooth unit.

12. The imitation candle device of claim 9, wherein the electronic module is a timing module.

13. The imitation candle device of claim 9, further comprising:

a lock including two clip legs; and an ejection component including:

a support leg;

protrusions on the support leg to allow insertion of the support leg into the two clip legs; and an ejection leg configured to extend towards an opposite direction of the support leg.

14. The imitation candle device of claim 13, wherein the ejection component further includes:

a middle section that surrounds the support leg; and an elastic element arranged within the middle section to facilitate ejection of the electronic module.

15. The imitation candle device of claim 14, wherein the elastic element includes a spring.

16. The imitation candle device of claim 14, wherein the support leg of the ejection component further comprises guiding slopes to facilitate insertion of the support leg into the lock.

17. The imitation candle device of claim 9, wherein the first subspace of the installation cavity has a rectangular shape.

18. The imitation candle device of claim 9, wherein the first subspace of the installation cavity has a cylindrical shape.

19. The imitation candle device of claim 9, further comprising an engagement element that extends into the installation cavity to secure the connection of the electronic module with the communication interface of the imitation candle device.

20. The imitation candle device of claim 9, wherein the electronic module includes a raised surface positioned near a first end of the electronic module, the raised surface configured to couple with the groove in the installation cavity to facilitate correct insertion of the electronic module.

21. The imitation candle device of claim 20, wherein the raised surface extends from the first end of the electronic module to the second end of the electronic module.

22. The imitation candle device of claim 20, wherein the raised surface and the groove are interchanged such that the groove runs at least partially down the first end of the electronic module and the second subspace of the installation cavity includes the raised surface positioned near the second surface.

23. The imitation candle device of claim 9, wherein the electronic module includes a surface feature near the first end of the electronic module to facilitate removal of the electronic module from the installation cavity by hand.

* * * * *